US007748469B1

(12) United States Patent
Todman et al.

(10) Patent No.: US 7,748,469 B1
(45) Date of Patent: Jul. 6, 2010

(54) FIREFIGHTING SYSTEM

(76) Inventors: Ulric S. Todman, 118 W. 120th St., New York, NY (US) 10027; Ulric A. Todman, 118 W. 120th St., New York, NY (US) 10027

( * ) Notice: Subject to any disclaimer, the term of this patent is extended or adjusted under 35 U.S.C. 154(b) by 458 days.

(21) Appl. No.: 11/869,093

(22) Filed: Oct. 9, 2007

(51) Int. Cl.
*A62C 13/62* (2006.01)

(52) U.S. Cl. ..... 169/70; 239/272

(58) Field of Classification Search ..... 169/66–70; 239/271, 272

See application file for complete search history.

(56) References Cited

U.S. PATENT DOCUMENTS 2,235,915 A * 3/1941 Bohan ..... 169/70
4,147,216 A * 4/1979 Schnepfe et al. ..... 169/70
4,485,877 A 12/1984 McMillan
5,062,486 A * 11/1991 McClenahan ..... 169/70
5,447,203 A 9/1995 McLoughlin
6,189,622 B1 2/2001 Audet
6,398,136 B1 6/2002 Smith
6,755,259 B2 * 6/2004 Peltola et al. ..... 169/47
2005/0199402 A1 9/2005 Moses

* cited by examiner

*Primary Examiner*—Davis Hwu

(57) ABSTRACT

The present invention provides a firefighting system using a boom truck for delivering fire suppressant fluid to remote areas in burning structures. The system includes a fluid delivery conduit having a distal end fitted with a nozzle that discharges fluid in a 360 degree arc perpendicular to the direction of the conduit. The nozzle is constructed using a first disk with a central opening, and a second disk attached in spaced relationship having a curved conical projection that extends back through the central opening in the first disk. A third disk with a conical forwardly extending projection is attached to the second disk. When the conical projection is forced through a window on a building wall section, fluid is discharged to otherwise inaccessible areas in the building and harmful gases are simultaneously vented from the building.

7 Claims, 5 Drawing Sheets

FIREFIGHTING SYSTEM

BACKGROUND OF THE INVENTION

1. Field of the Invention

The present invention relates to the field of firefighting equipment, and more particularly to a firefighting nozzle used with a remote fire suppressant delivery system.

2. Description of Related Art

Firefighters risk their lives daily in fighting fires in virtually the same way that fires have been fought for over a century. While there have been many improvements over the years, in response times, in communications between firefighters and command, in delivery of water and other suppressants to the burning structures, there has been a rise in firefighter fatalities due to the higher combustibility and toxicity of petroleum-based plastics and other modern synthetic materials found increasingly in home and business interior and furnishings.

At the present time, structures are vented and gases are allowed to burn off while firefighters are forced to wait at a safe distance. This takes valuable time, during which the fire continues to burn and can spread rapidly throughout the structure, resulting in a larger, more dangerous blaze, which takes longer for firefighting teams to bring under control. Water cannons and conventional hoses mounted on aerial ladders outside the blazing structure cannot be effectively deployed to both break into buildings and effectively deliver sufficient volumes of water to the necessary interior perimeter areas.

As can be seen by reference to the following U.S. Pat. Nos. 4,485,877; 5,447,203; 6,189,622; 6,398,136; and U.S. Publn. 20050199402, the prior art is replete with myriad and diverse firefighting devices.

While all of the aforementioned prior art constructions are adequate for the basic purpose and function for which they have been specifically designed, they are uniformly deficient with respect to their failure to provide a simple, efficient, and practical firefighting nozzle in combination with a remote suppressant delivery system.

As a consequence of the foregoing situation, there has existed a longstanding need for a new and improved firefighting system, and the provision of such a device is a stated objective of the present invention.

BRIEF SUMMARY OF THE INVENTION

Briefly stated, the present invention provides a firefighting system using a boom truck for delivering fire suppressant fluid to remote areas in burning structures. The system includes a fluid delivery conduit having a distal end fitted with a nozzle that discharges fluid in a 360° arc perpendicular to the direction of the conduit. The nozzle is constructed using a first disk with a central opening, and a second disk attached in spaced relationship having a curved conical projection that extends back through the central opening in the first disk. A third disk with a conical forwardly extending projection is attached to the second disk. When the conical projection is forced through a window on a building wall section, fluid is discharged to otherwise inaccessible areas in the building and harmful gases are simultaneously vented from the building.

The object of this invention is the provision of a safer and more effective means of fighting a building fire during the critical early stages of the firefighting process, before the fire accelerates to explosive levels and before it is necessary for firefighting teams to enter the structure to fight the fire by conventional means.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
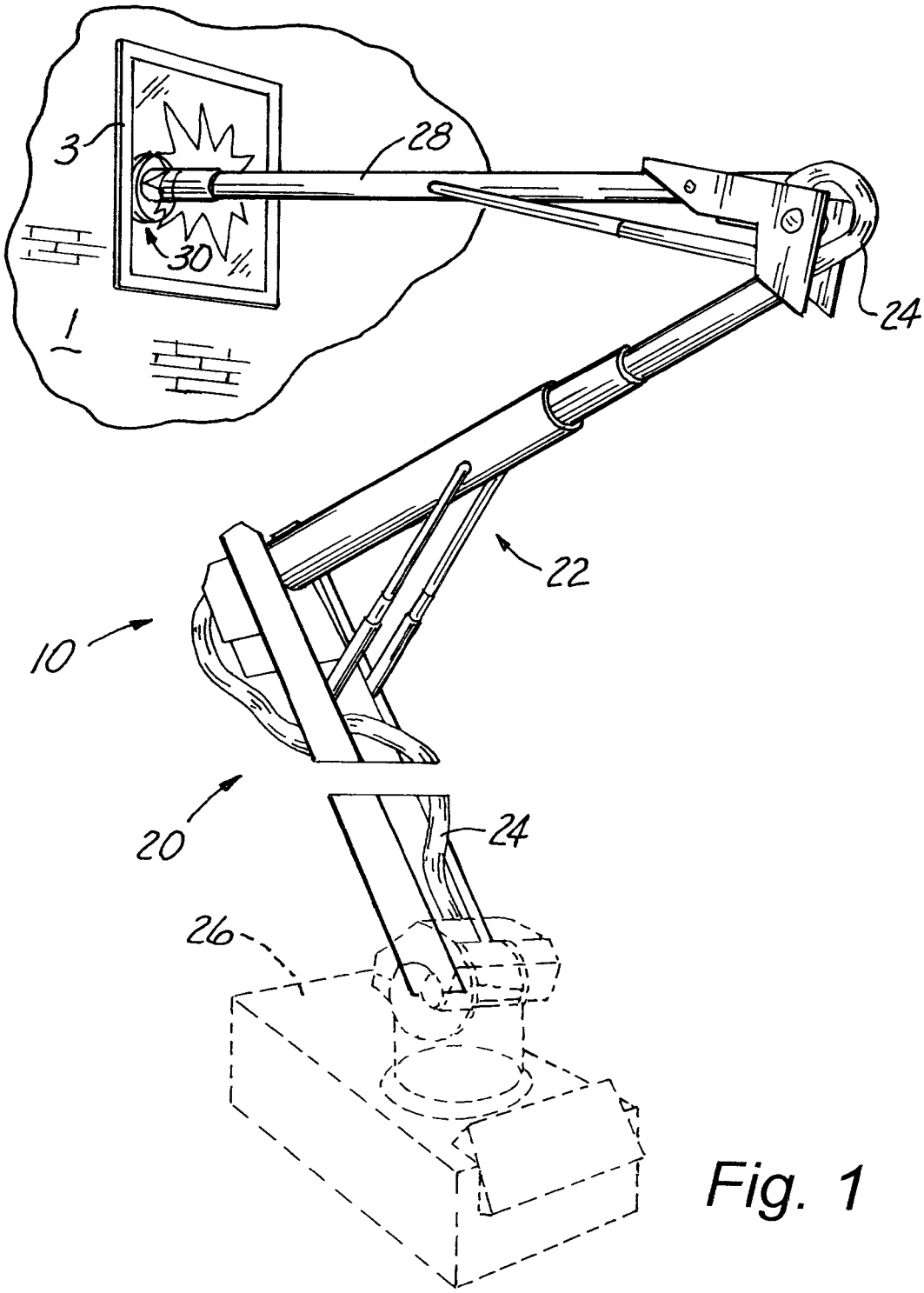
FIG. 1 is a perspective view showing the firefighting system of the present invention, including the nozzle assembly in combination with a hydraulic delivery system.
Figure 2:
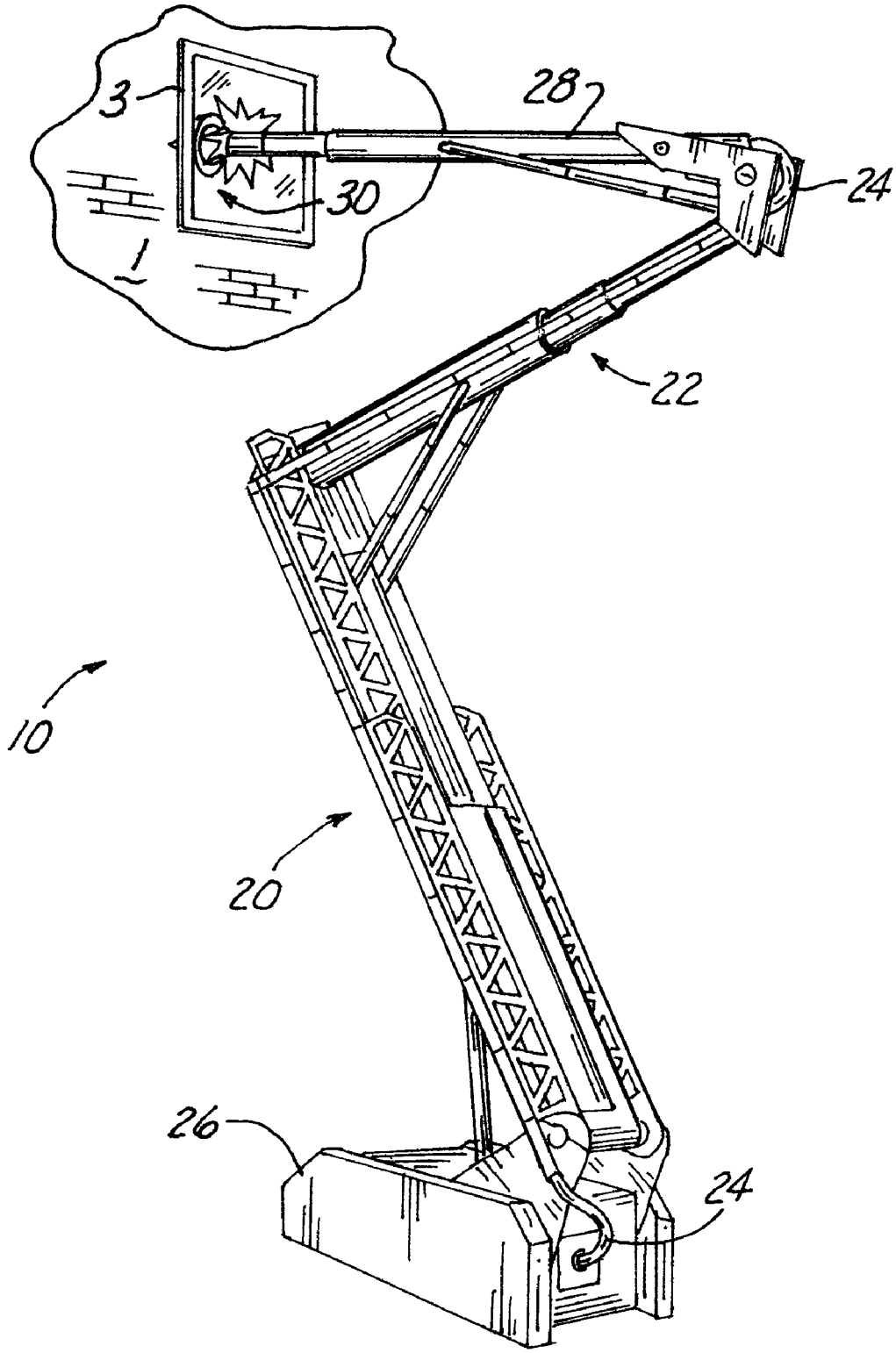
FIG. 2 is a perspective view similar to FIG. 1, but showing the nozzle in combination with an aerial truss and telescoping boom device.
Figure 3:
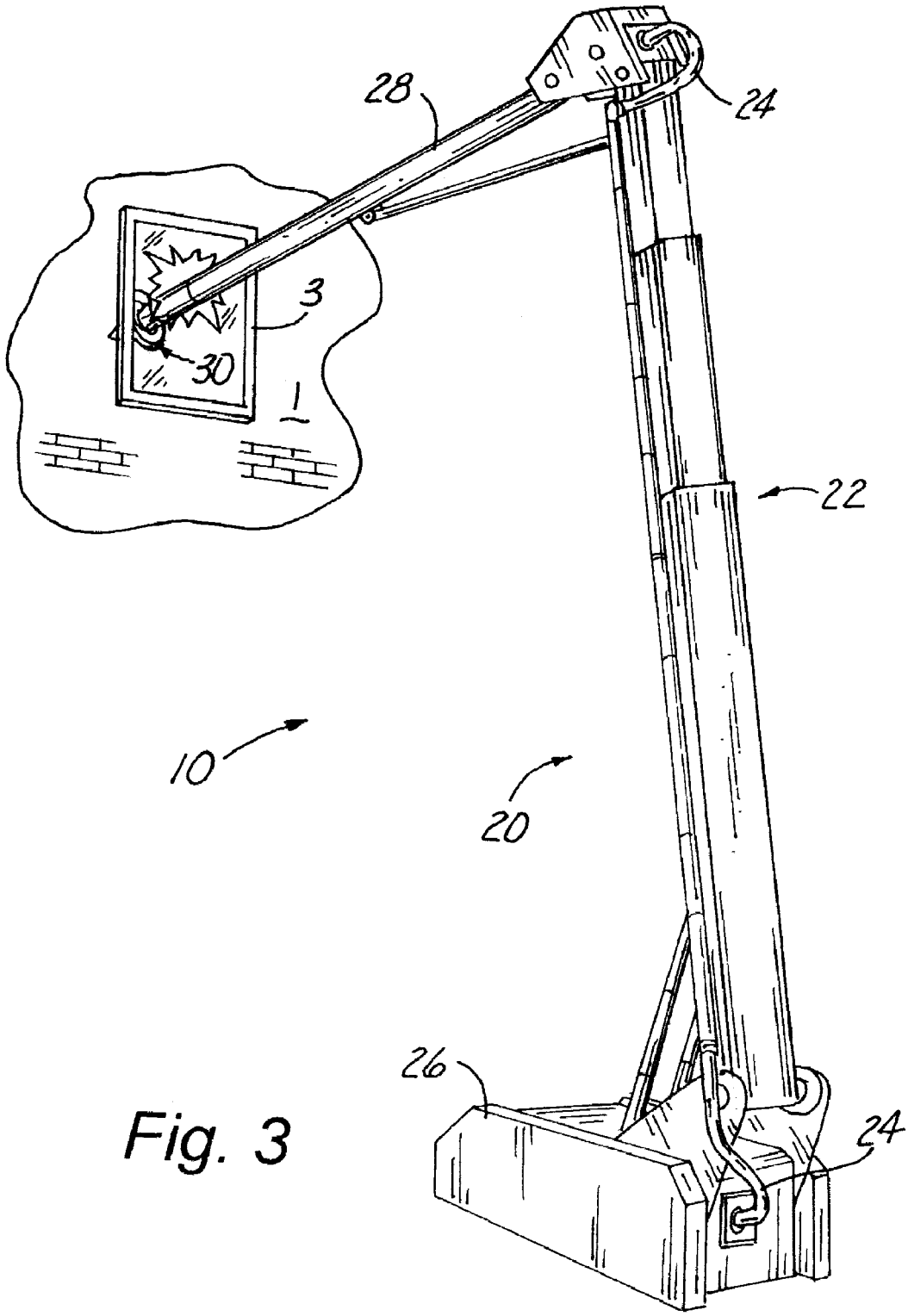
FIG. 3 is a perspective view similar to FIGS. 1 and 2, but showing the nozzle in combination with an alternate telescoping boom device.
Figure 4:
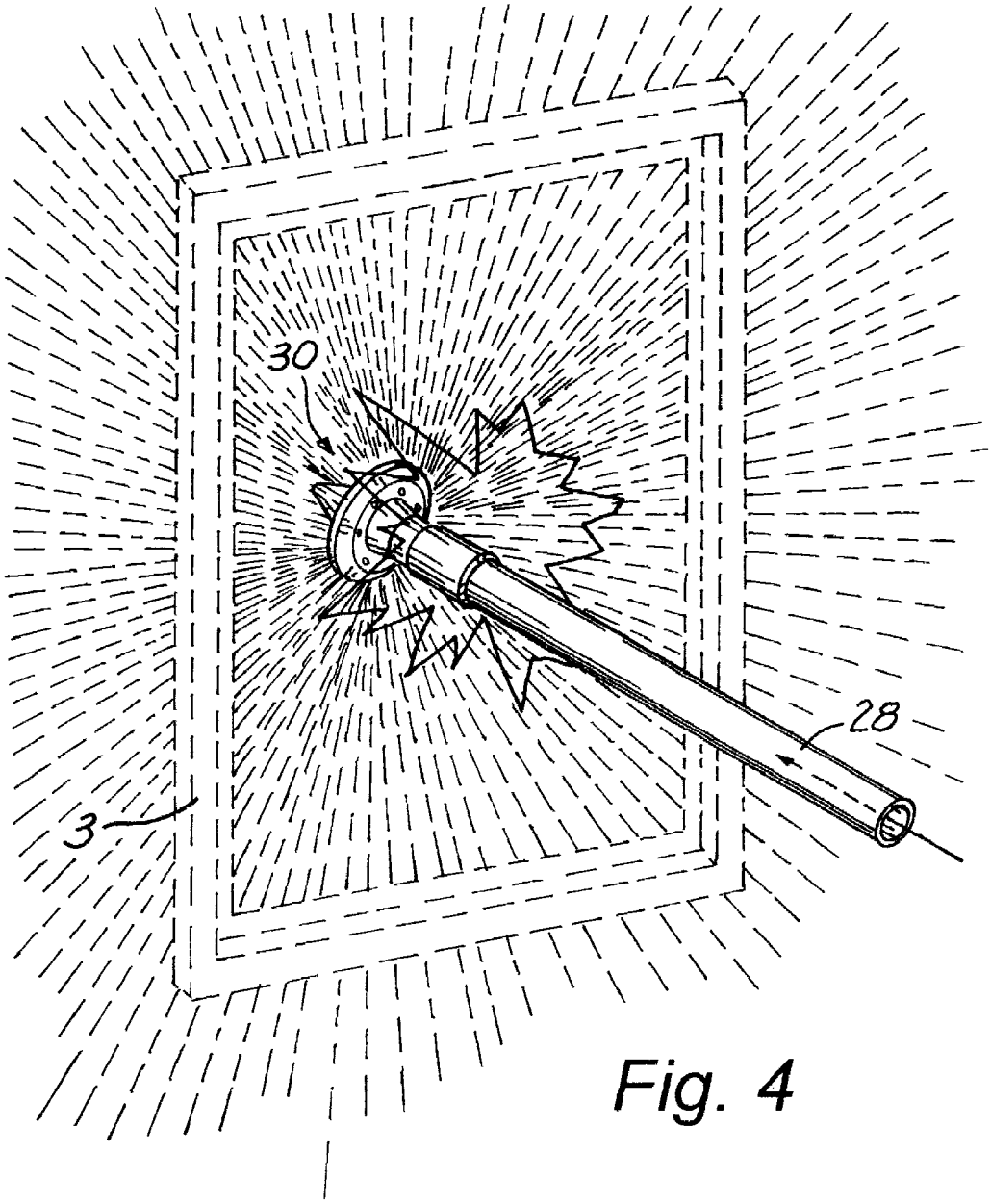
FIG. 4 is an enlarged partial perspective view illustrating the nozzle forced through a building window and spraying fire suppressant in a 360 degree arc perpendicular to the fluid conduit.

As can be seen by reference to the drawings, and in particular to FIG. 1, the firefighting system that forms the basis of the present invention is designated generally by the reference number 10. The firefighting system 10 uses a remote fire suppressant delivery device 20 including a moving articulated boom 22 with an attached conduit 24. The proximal end of the conduit 24 is disposed in fluid communication with a fire suppressant source 26. The fire suppressant may be water or foam, and the source may be water hydrant or a mobile reservoir. The distal end of the conduit 24 may include a rigid reinforced aluminum pipe 28 as shown in FIG. 1. Alternate delivery systems are shown in FIGS. 2 and 3.

Figure 5:
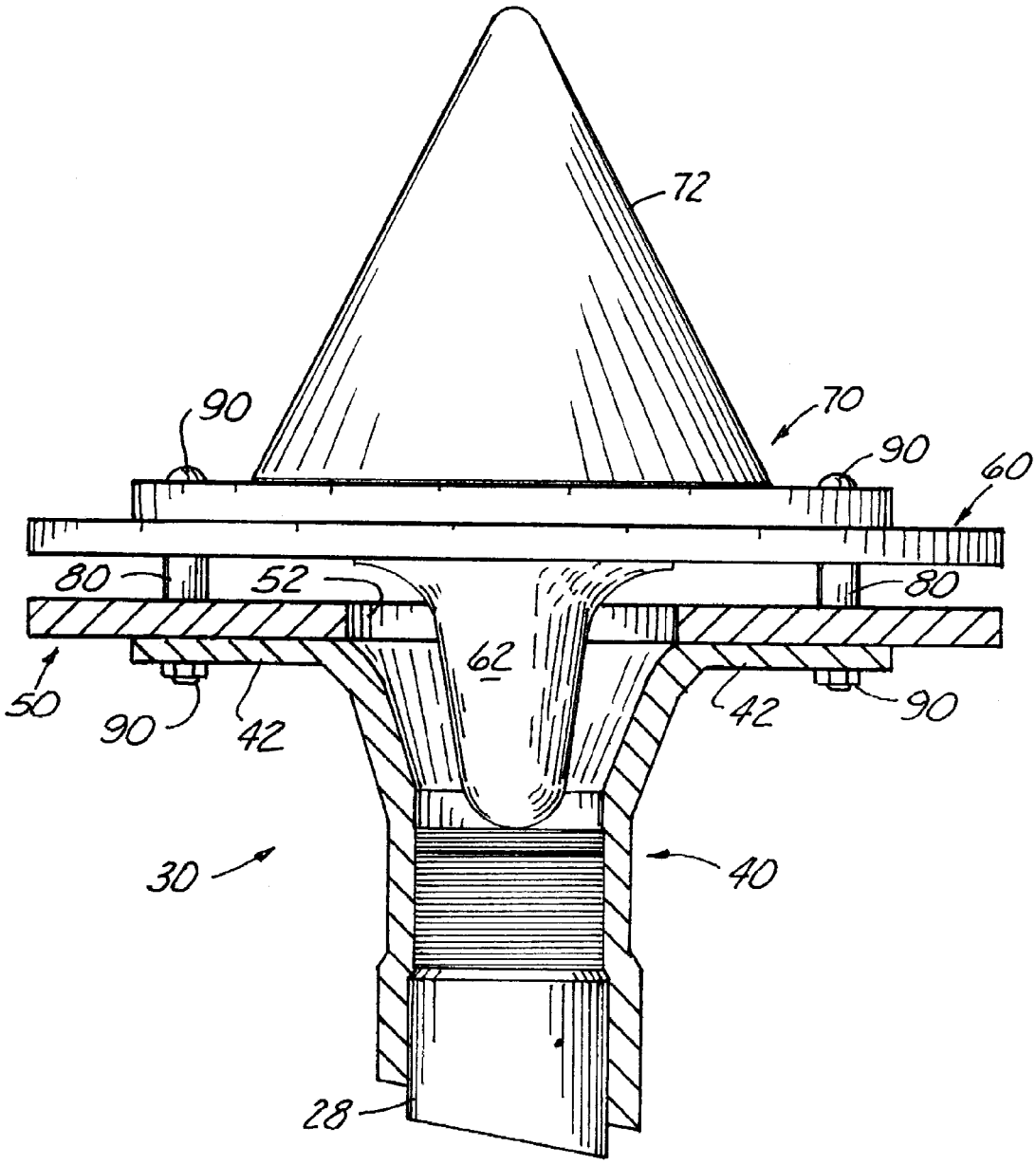
FIG. 5 is an enlarged side elevation view with portions cut away to show the components of the nozzle.

As best shown in FIG. 5, a nozzle assembly 30 is attached to the pipe 28. The nozzle assembly 30 includes a coupling 40 with a flanged end 42, a first disk 50 with a central opening 52, a second disk 60 with a curved conical projection 62, a third disk 70 with a conical projection 22, a number of spacer cylinders 80, and fasteners 90 that interconnect the coupling 40 with the first, second, and third disks 50, 60, and 70.

The nozzle 30 for firefighting is designed to be affixed to an aluminum pipe 28, mounted on a scissor or articulating telescopic aerial boom 22 that will deliver water in a 360° arc, perpendicular to the direction in which the pipe 28 and nozzle 30 are pointed.

The preferred embodiment of this invention consists of 18 inch diameter disks 50 and 60 which are securely bolted together through spacers 80, positioned equidistant from each other around the disks 50 and 60 and providing a uniform space between the disks of ¼-½ inch. The nozzle assembly 30 is attached to the aluminum pipe 28 by a standard heavy duty threaded or clamp type coupling 40.

The first disk 50, which attaches to the pipe 28 by means of a coupling collar 40, is affixed by the same bolts 90 described above, has a six inch circular hole 52 cut into its center to allow for water flow, under pressure, from the pipe 28 into the ¼-½ inch gap between the first and second disks 50 and 60.

The second disk 60 which bolts to the first disk 50 features a curved, conical flange 62 located in the center of the disk 60 and projecting through the opening 52 in disk 50, back toward the pipe 28 and opposite the direction of water flow. This curved flange 62 directs water flow and increases the pressure of water entering the gap between the disks 50 and 60.

A third disk 70 is attached directly to the leading surface of the second disk 60, utilizing the same bolts 90 which attach disk 50 and disk 60 to each other. Disk 70 is 14 inches in diameter and features a 12 inch diameter conical extension 72 which projects forward 12 inches in the direction of water flow and which functions as a battering ram as the assembly 30 is projected through a window 3 into a burning structure 1. This will allow firefighters to remotely vent the fire and introduce a high volume of water during those critical initial minutes before the firefighting team enters the structure. This extension 72 also functions as a reinforcement for the entire assembly 30, providing additional strength and preventing disks 50 and 60 from sustaining damage or buckling as the assembly 30 encounters interior partitions, furnishing, or other burning contents in the space.

The nozzle 30 will be fabricated of the same composition metals, and similar heavy duty gauge as are conventional hose mounted firefighting nozzles, and is reinforced a described above. The nozzle assembly 30 contains no moving parts to malfunction or wear out. The water flow and pressure are controlled from the pumper truck or other standard firefighting pumping equipment.

The nozzle device 30 will enable firefighters to remotely deliver water to perimeter areas and rooms of a building interior; and simultaneously to walls, ceilings, and floors, saturating furniture and other flammable contents, and cooling the gasses created by the many combustible materials found in furnishings and those other contents. The nozzle device 30 will be able to reach those perimeter areas of a fire in the first critical minutes when the fire and the materials are forming hot gasses which become explosive as the fire seeks oxygen. The nozzle device 30 forms a water barrier curtain of 360°, reaching areas that cannot be reached from outside the burning structure by conventional hand held hoses, or by conventional aerial mounted water cannons. Securely coupled to a specially fitted, 16-20 foot 3½ inch inside diameter, rigid reinforced aluminum pipe 28, the nozzle device 30 is projected directly through a window 3 into the burning structure 1, producing a saturating spray, which will penetrate smoke, flame, heat and accumulated gasses to lower temperatures below the point of combustion and reduce the hazard to firefighters. This system eliminates the vortex that carries oxygen to the fire under conventional fire fighting methods.

The 360° curtain nozzle 30 and the specially fitted 16-20 foot aluminum pipe 28 are designed to be mounted on a new class of powered firefighting equipment 20, which would utilize a telescoping, hydraulic boom 22, such as are used on concrete pumping trucks, and piping and hoses currently in use on firefighting trucks.

The present invention relates to firefighting equipment and to the way fires are fought. Specifically it provides the means to shorten the amount of time it will take to effectively deliver a high volume curtain of water in a 360° arc in the first critically important stage, while at the same time allowing the fire to be vented, without it being necessary for firefighters to physically approach or enter the structure to accomplish this.

This invention will allow for rapid venting of a structure 1 without putting the firefighter in harms way, and will allow firefighters to deliver high volumes of water via a 360° water curtain to areas of the building which cannot be reached by conventional equipment and methods, without placing the firefighters in dangerously close proximity to the structure, or inside the building perimeter.

This invention will save precious time in the initial stages of fighting a fire. Firefighters will be able to remotely penetrate a structure to enable venting, and immediately apply a high volume 360° curtain of water to effectively extinguish perimeter fire, reduce heat and cool gasses, and create a cooler perimeter zone, which will be safer for firefighters to enter in order to continue to fight the fire using more conventional equipment and methods.

With a 360° water curtain nozzle 30 and 16-20 foot rigid pipe 28 mounted on the telescoping hydraulic boom 22, firefighters can reach point of entry from 10 feet to 160 feet above street level, penetrate the burning structure, vent the fire, bring high volumes of water immediately and effectively to the perimeter areas, reduce zone temperatures and reduce the threat of explosion, without risk to firefighter's lives in closely approaching or entering the structure to accomplish these tasks.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A firefighting system, comprising:

a remote fire suppressant delivery device including a movable boom, a fire suppressant source, a delivery conduit attached to the boom, the conduit having a proximal end in fluid communication with the fire suppressant source, and a distal end;

a coupling operably attached to the distal end of the conduit, the coupling including a flanged end;

a first disk attached to the flanged end of the conduit, the first disk having a central opening disposed in alignment with the distal end of the conduit;

a second disk attached to the first disk in spaced relationship thereto, the second disk having a central projection disposed to extend through and to be laterally spaced from the central opening in the first disk toward the distal end of the conduit; and a third disk attached to the second disk, the third disk having a conical projection disposed to extend away from the distal end of the conduit.

2. The system of claim 1, wherein the central projection of the second disk has a rounded free end, an enlarged base, and a curved surface between the base and the free end.

3. The system of claim 2, wherein a plurality of spacer cylinders are disposed between the first disk and the second disk.

4. The system of claim 3, wherein a fastener connects each of the plurality of spacer cylinders with the coupling, the first disk, the second disk, and the third disk.

5. The system of claim 1, wherein a plurality of spacer cylinders are disposed between the first disk and the second disk.

6. The system of claim 5, wherein a fastener connects each of the plurality of spacer cylinders with the coupling, the first disk, the second disk, and the third disk.

7. The system of claim 1, wherein the movable boom is a telescoping or scissors-type, and is powered electrically, hydraulically, pneumatic, or otherwise.

* * * * *